US009546441B1

(12) United States Patent
Chen

(10) Patent No.: US 9,546,441 B1
(45) Date of Patent: Jan. 17, 2017

(54) EMBROIDERY DECORATION

(71) Applicant: Teng-Kuei Chen, Taipei (TW)

(72) Inventor: Teng-Kuei Chen, Taipei (TW)

( * ) Notice: Subject to any disclaimer, the term of this patent is extended or adjusted under 35 U.S.C. 154(b) by 55 days.

(21) Appl. No.: 14/804,326

(22) Filed: Jul. 20, 2015

(51) Int. Cl.

| | |
|---|---|
| ***D05C 17/00*** | (2006.01) |
| ***D05C 1/04*** | (2006.01) |
| ***D05C 1/06*** | (2006.01) |
| ***B44D 3/18*** | (2006.01) |

(52) U.S. Cl.
CPC ..... *D05C 17/00* (2013.01); *B44D 3/18* (2013.01); *D05C 1/04* (2013.01); *D05C 1/06* (2013.01)

(58) Field of Classification Search
CPC ..... D05C 1/02; D05C 1/04; D05C 1/06; D05C 17/00; D05C 9/04; D05C 9/12; D06C 3/00; D06C 3/08; B44D 3/18
See application file for complete search history.

(56) References Cited

U.S. PATENT DOCUMENTS 1,032,839 A * 7/1912 Kemler ..... B44D 3/185 160/380
2,574,064 A * 11/1951 Rosen ..... G09B 19/20 112/2
2,575,470 A * 11/1951 Salz ..... D05C 1/02 139/34
3,678,607 A * 7/1972 Tabor ..... D05C 1/02 38/102.91
4,404,750 A * 9/1983 Marx ..... D05C 1/08 112/439
4,608,939 A * 9/1986 Lampley ..... D05C 1/02 112/260
6,158,153 A * 12/2000 Morgan ..... D05C 1/04 38/102.2
7,350,473 B2 * 4/2008 Henry ..... D05B 97/12 112/117
8,074,384 B2 * 12/2011 Kuwabara ..... D05B 91/10 33/13
8,261,680 B2 * 9/2012 Oe ..... D05B 97/02 112/260

FOREIGN PATENT DOCUMENTS

CN 202157184 U * 3/2012

* cited by examiner

*Primary Examiner* — Ismael Izaguirre
(74) *Attorney, Agent, or Firm* — Hershkovitz & Associates, PLLC; Abe Hershkovitz

(57) ABSTRACT

An embroidery decoration has an outer frame and a stitching plate. The stitching plate is detachably mounted in the outer frame. An outer periphery of the stitching plate abuts an inner periphery of the outer frame. The stitching plate has multiple through holes formed through the plate surfaces for needles and threads to directly pass through for stitching on the stitching plate. After stitching, the outer frame, the stitching plate and the thread on the stitching plate form the end product. The stitching plate is solid in a fixed shape, thereby eliminating the problem of loosening and facilitating convenience in stitching. The embroidery decoration is mainly composed of two components made by plastic injection molding, such that the manufacturing cost is reduced.

12 Claims, 6 Drawing Sheets

EMBROIDERY DECORATION

BACKGROUND OF THE INVENTION

1. Field of the Invention

The present invention relates to a decoration having embroidery stitched on it.

2. Description of the Prior Arts

With reference to FIG. 6, a conventional embroidery decoration has an inner frame 91, an outer frame 92 and a piece of cloth 93. The inner frame 91 and the outer frame 92 are both circular. An outer diameter of the inner frame 91 corresponds to an inner diameter of the outer frame 92. The outer frame 92 is made of an elastic material, and the inner frame 91 is made of a material that is tougher than the outer frame 92. The outer frame 92 has a hanging segment 921 formed on an outer wall of the outer frame 92. When the embroidery decoration is in use, the cloth 93 is put on the inner frame 91, and then the outer frame 92 is pressed downward to be tightly mounted on the inner frame 91. Thus, the cloth 93 is tightly clamped between the inner frame 91 and the outer frame 92 and kept tightly braced. At this time, a user can conveniently stitch on the cloth 93 without worrying about the loosening of the cloth 93. After stitching, superfluous part of the cloth 93 is cut off along the outer wall of the outer frame 92, and then the embroidery decoration can be hung up via the hanging segment 921.

However, the conventional embroidery decoration has the following shortcomings:

First, during the stitching, a needle would prick through the cloth 93 again and again, which means force is continuously applied on the cloth 93. Therefore, the cloth 93 may be gradually separated from the inner frame 91 and the outer frame 92 and loosened instead of retaining a tightened status.

Second, the superfluous part of the cloth 93 requires further cutting off after stitching. The cutting not only takes time and effort, but also wastes material.

Third, the conventional embroidery decoration comprises three components in total, i.e. the inner frame 91, the outer frame 92, and the cloth 93. Too many components increase the manufacturing cost. In particular, the cloth 93 costs higher in manufacturing than the frames 91, 92, which can be made by plastic injection molding.

Fourth, there is no structure on the frames 91, 92 or the cloth 93 that can assist the user with aiming and determining the stitching position. Therefore, it is hard for children or beginners of embroidery to accurately stitch and complete a pattern that is exactly the same as the example pattern.

To overcome the shortcomings, the present invention provides an embroidery decoration to mitigate or obviate the aforementioned problems.

SUMMARY OF THE INVENTION

The main objective of the present invention is to provide an embroidery decoration that eliminates the problem of loosening of the stitched component.

The embroidery decoration has an outer frame and a stitching plate. The stitching plate is detachably mounted in the outer frame. An outer periphery of the stitching plate abuts an inner periphery of the outer frame. The stitching plate has multiple through holes formed through the plate surfaces for needles and threads to pass through for stitching.

When the embroidery decoration is in use, the stitching plate replaces the conventional cloth. A needle and a thread are directly passed through the through holes to stitch on the stitching plate. After stitching, the outer frame, the stitching plate and the thread on the stitching plate form the end product. The stitching plate is solid in a fixed shape, thereby eliminating the problem of loosening and facilitating convenience in stitching on the stitching plate. In addition, the stitching plate and the outer frame correspond to each other in shape, and thus do not need further cutting as the conventional cloth, thereby simplifying the manufacturing and avoiding waste of the material. Further, the embroidery decoration as described is mainly composed of two components i.e. the outer frame and the stitching plate, and the two components are made by plastic injection molding, such that the manufacturing cost is lower than the conventional embroidery decoration that has three components including cloth.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
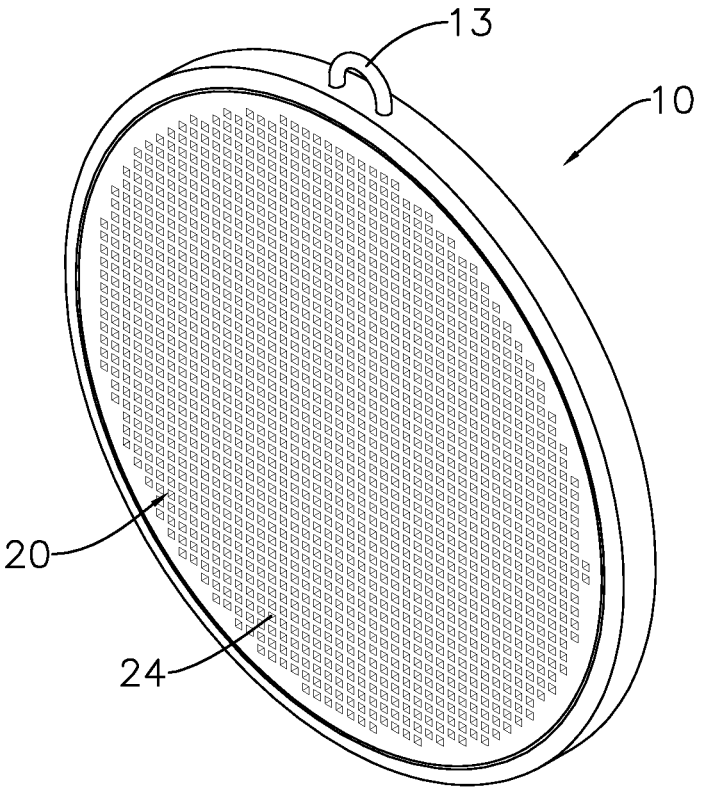
FIG. 1 is a perspective view of an embroidery decoration in accordance with the present invention.
Figure 2:
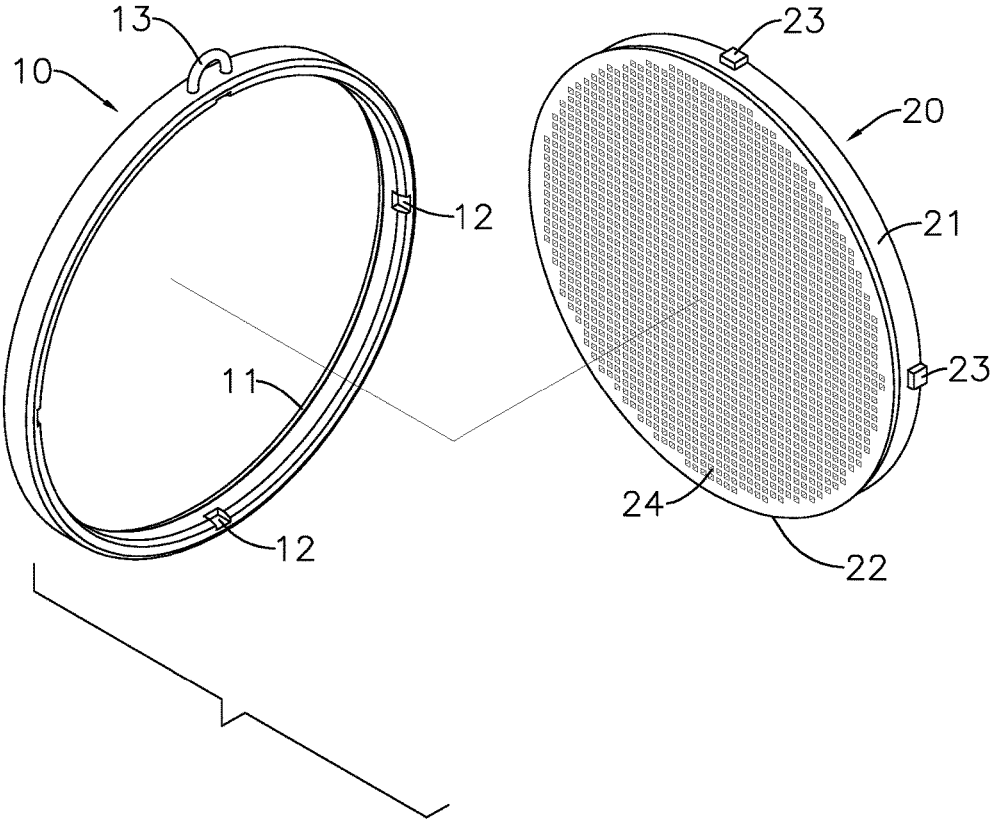
FIG. 2 is an exploded perspective view of the embroidery decoration in FIG. 1.

With reference to FIGS. 1 and 2, an embroidery decoration in accordance with the present invention comprises an outer frame 10 and a stitching plate 20.

Figure 3:
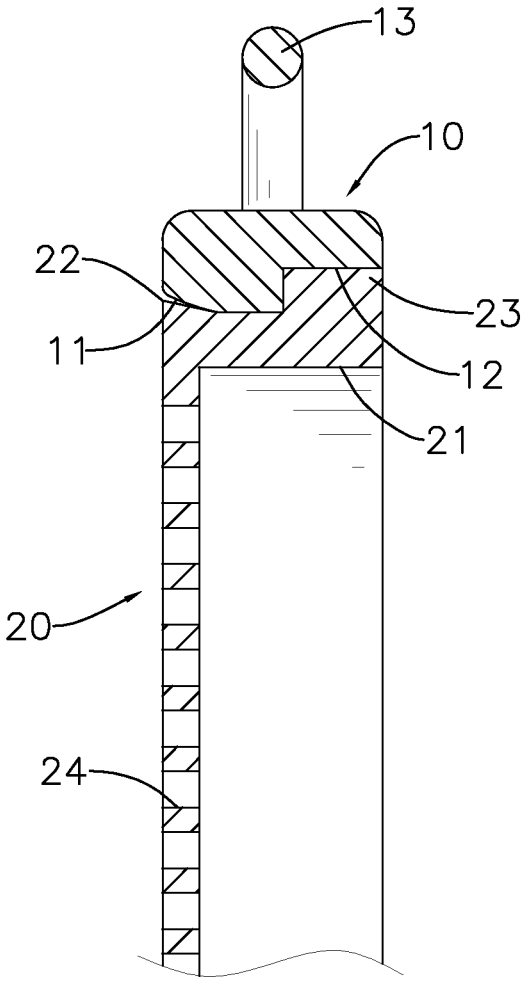
FIG. 3 is a side view in partial section of the embroidery decoration in FIG. 1.

With reference to FIGS. 1 and 3, the outer frame 10 is a circular hoop, and has an inner periphery, an outer periphery, a first axial side, and a second axial side opposite to the first axial side. The outer frame 10 further has an annular recess 11, multiple engaging recesses 12 and a hanging segment 13. The annular recess 11 is formed in the inner periphery of the outer frame 10, is disposed adjacent to the first axial side, and axially communicates with an exterior environment via the first axial side. An inner diameter of the annular recess 11 is gradually decreased along a direction from the first axial side to the second axial side. The engaging recesses 12 are formed in the inner periphery of the outer frame 10, are annularly arranged apart from each other, are disposed adjacent to the second axial side, and axially communicates with the exterior environment via the second axial side. The hanging segment 13 is formed on the outer periphery of the outer frame 10, is U-shaped and has two ends connected to the outer periphery of the outer frame 10. In a preferred embodiment, the outer frame 10 is preferably made of, but not limited to, plastic.

The stitching plate 20 is detachably mounted in the outer frame 10, is a circular plate, and has an outer plate surface, an inner plate surface and an outer periphery. The stitching plate 20 further has an axis defined perpendicularly relative to the plate surfaces. The outer periphery of the stitching plate 20 is annularly formed between the plate surfaces.

The outer frame 20 further has an annular wall 21, an annular flange 22, and multiple protrusions 23. The annular wall 21 is axially formed on the inner plate surface and is formed annularly around the outer periphery of the stitching plate 20. An outer wall of the annular wall 21 is aligned with the outer periphery of the stitching plate 20. The outer wall of the annular wall 21 and the outer periphery of the stitching plate 20 abut the inner periphery of the outer frame 10. The annular flange 22 is transversely formed on the outer periphery of the stitching plate 20 and abuts the annular recess 11 of the outer frame 10. An axial surface of the annular flange 22 and the outer plate surface are aligned with each other. An outer diameter of the annular flange 22 is gradually decreased along a direction from the outer plate surface to the inner plate surface. The protrusions 23 are transversely formed on the annular wall 21. A transverse protruding distance of the protrusion 23 from the annular wall 21 of the stitching plate 20 is larger than a transverse protruding distance of the annular flange 22 from the outer periphery of the stitching plate 20. The protrusions 23 are annularly arranged apart from each other. Axial ends of the protrusions 23 and an axial surface of the annular wall 21 are aligned with each other. The protrusions 23 respectively abut the engaging recesses 12, and the protrusions 23 and the annular flange 22 axially clamp the outer frame 10, thereby securely connecting the stitching plate 20 and the outer frame 10.

The stitching plate 20 further has multiple through holes 24. The through holes 24 are formed through the plate surfaces for needles and threads to pass through for stitching. The through holes 24 are arranged in order, and preferably are arranged in a checkered pattern.

The protrusions 23 and the engaging recesses 12 fix the stitching plate 20 and the outer frame 10 at a specific relative angle, which allows the checkered through holes 24 to be arranged in a direction corresponding to the position of the hanging segment 13 of the outer frame 10. Thus, when the embroidery decoration as described is hung up via the hanging segment 13, a completed stitched pattern on the stitching plate 20 would not be inclined or deviated transversely. In a preferred embodiment, the stitching plate 20 is preferably made of, but not limited to, plastic.

When the embroidery decoration as described is in use, the stitching plate 20 is mounted in the outer frame 10 first. Although the outer diameters of the annular flange 22 and the protrusions 23 of the stitching plate 20 are larger than the inner diameter of the outer frame 10, the stitching plate 20 still can be deformed slightly due to the resilience of the plastic material. The stitching plate 20 is mounted into the outer frame 10 at a same relative angle at which the annular flange 22 is disposed toward the outer frame 10.

Figure 4:
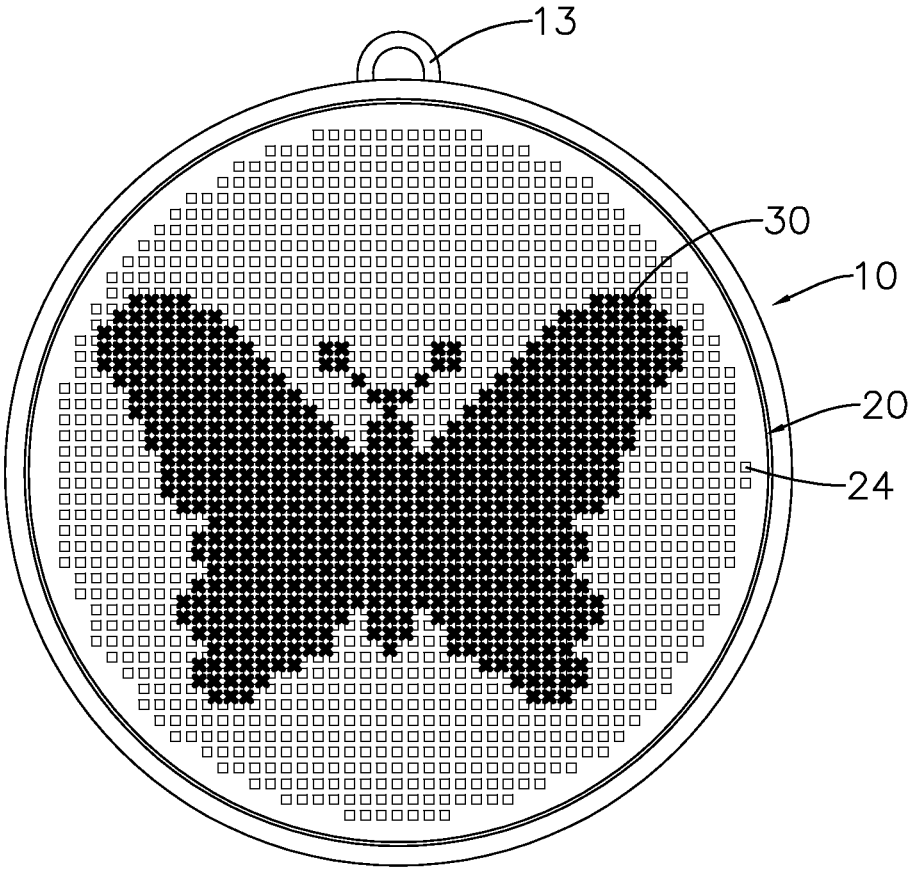
FIG. 4 is a front view of an end product after stitching of the embroidery decoration in FIG. 1.

Then, the user inserts a thread 30 passing through the through holes 24 of the stitching plate 20 back and forth by a needle to stitch on the stitching plate 20 as shown in FIG. 4. After stitching, the outer frame 10, the stitching plate 20 and the thread 30 on the stitching plate 20 form the end product. The stitching plate 20 is solid in a fixed shape, thereby eliminating the problem of loosening and facilitating convenience in stitching on the stitching plate 20. In addition, the through holes 24 of the stitching plate 20 are arranged in order, and preferably are arranged in a checkered pattern, which facilitates convenience for user in estimating the insertion position of the needle, thereby accurately stitching and completing a pattern that is exactly the same as the example pattern. Nevertheless, the outer frame 10 can be designed in different colors to cooperate with threads 30 in different colors, thereby matching different festivals or occasions. Further, the embroidery decoration as described is mainly composed of two components made by plastic injection molding, such that the manufacturing cost is reduced.

Figure 5:
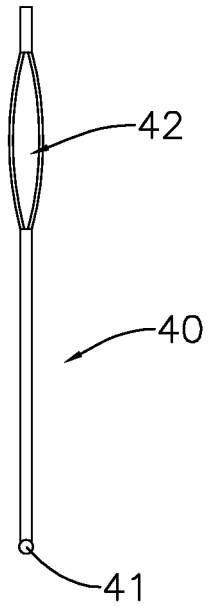
FIG. 5 is a front view of a needle that is used with the embroidery decoration in FIG. 1.
Figure 6:
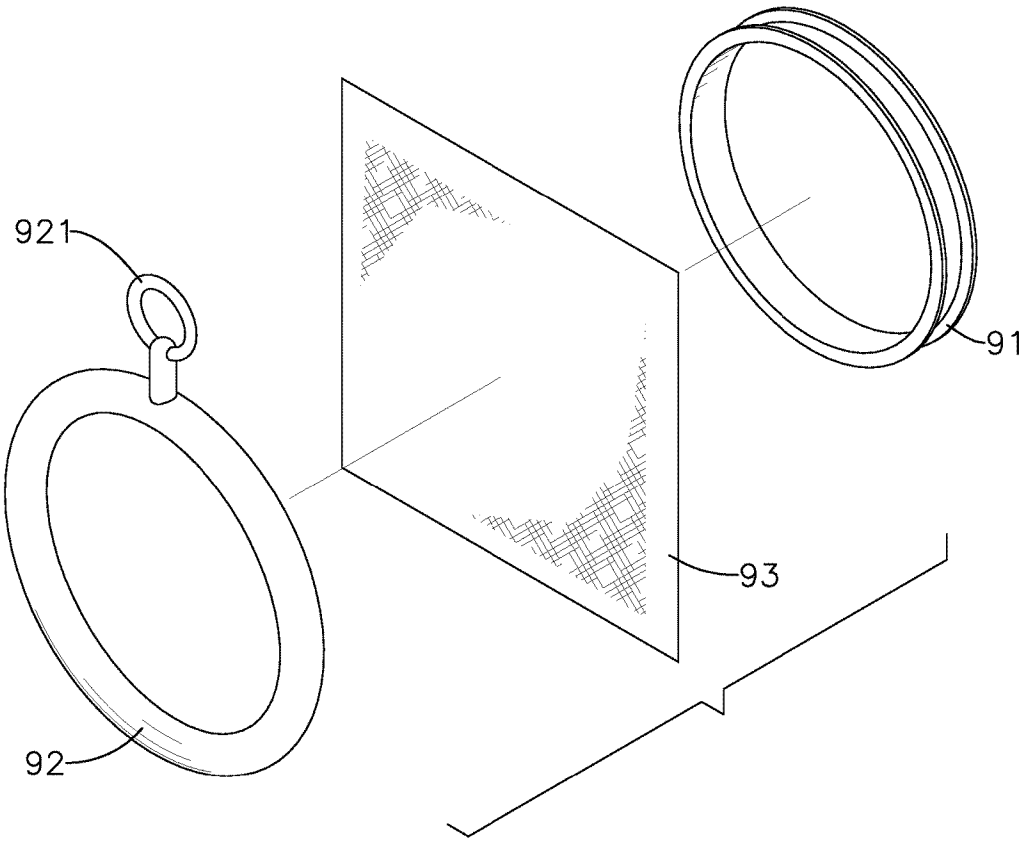
FIG. 6 PRIOR ART
FIG. 6 is an exploded perspective view of a conventional embroidery decoration in accordance with the prior art.

With reference to FIG. 5, the needle 40 that is used with the embroidery decoration is made of plastic, and has a point 41 disposed on an end of the needle with a volume larger than the needle head, which prevents hands of the user from stabbing to enhance the safety. In addition, the needle hole 42 is larger than that of the conventional needle to conveniently receive the thread 30 passed through.

The hanging segment 13 of the outer frame 10 enables the embroidery decoration to be hung up as a decoration. However, in another preferred embodiment, the embroidery decoration may be implemented without any hanging segment, and is fixed on another object by others ways, such as gluing, taping and so on. Thus, the embroidery decoration still can be used as a decoration.

In another preferred embodiment, the through holes of the stitching plate may be arranged in other patterns other than the checked pattern, for example, in a plum-blossom pattern.

In another preferred embodiment, the outer frame may be implemented without the annular recess and the engaging recess, and the stitching plate also may be implemented without the annular flange and the protrusions. The stitching plate directly and transversely abuts the inner periphery of the outer frame.

In another preferred embodiment, the stitching plate may be implemented without the annular wall, and is a simple slim plate instead.

In another preferred embodiment, both the outer frame and the stitching plate may not be circular, and may be heart-shaped, egg-shaped, rectangular, hexagonal and so on.

In another preferred embodiment, the outer frame and the stitching plate may not be made of plastic material, as long as the material of the outer frame is slightly elastic and deformable to clamp the stitching plate.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An embroidery decoration comprising:

an outer frame having an inner periphery; and a stitching plate detachably mounted in the outer frame, and having an outer plate surface;

an inner plate surface;

an axis defined perpendicularly relative to the outer plate surface;

an outer periphery annularly formed between the plate surfaces, and abutting the inner periphery of the outer frame; and multiple through holes formed through the plate surfaces for needles and threads to pass through for stitching.

2. The embroidery decoration as claimed in claim 1, wherein the through holes of the stitching plate are arranged in order.

3. The embroidery decoration as claimed in claim 2, wherein the through holes of the stitching plate are arranged in a checkered pattern.

4. The embroidery decoration as claimed in claim 1, wherein the stitching plate has an annular wall axially formed on the inner plate surface, formed annularly around the outer periphery of the stitching plate, and having an outer wall aligned with the outer periphery of the stitching plate and abutting the inner periphery of the outer frame.

5. The embroidery decoration as claimed in claim 4, wherein the outer frame has a first axial side;

a second axial side opposite to the first axial side;

an annular recess formed in the inner periphery of the outer frame, disposed adjacent to the first axial side, and axially communicating with an exterior environment via the first axial side; and multiple engaging recesses formed in the inner periphery of the outer frame, annularly arranged apart from each other, disposed adjacent to the second axial side, and axially communicating with the exterior environment via the second axial side; and the stitching plate has an annular flange transversely formed on the outer periphery of the stitching plate, and abutting the annular recess; and multiple protrusions transversely formed on the annular wall of the stitching plate, annularly arranged apart from each other, and respectively abutting the engaging recesses;

wherein the protrusions and the annular flange axially clamp the outer frame.

6. The embroidery decoration as claimed in claim 5, wherein in the stitching plate, an axial surface of the annular flange and the outer plate surface are aligned with each other; and axial ends of the protrusions and an axial surface of the annular wall are aligned with each other.

7. The embroidery decoration as claimed in claim 5, wherein a transverse protruding distance of the annular flange from the outer periphery of the stitching plate is less than a transverse protruding distance of the protrusion from the annular wall of the stitching plate.

8. The embroidery decoration as claimed in claim 5, wherein in the outer frame, an inner diameter of the annular recess is gradually decreased along a direction from the first axial side to the second axial side; and in the stitching plate, an outer diameter of the annular flange is gradually decreased along a direction from the outer plate surface to the inner plate surface.

9. The embroidery decoration as claimed in claim 1, wherein the outer frame has a hanging segment formed on an outer periphery of the outer frame.

10. The embroidery decoration as claimed in claim 9, wherein the hanging segment of the outer frame is U-shaped and has two ends connected to the outer periphery of the outer frame.

11. The embroidery decoration as claimed in claim 1, wherein the outer frame and the stitching plate are both circular.

12. The embroidery decoration as claimed in claim 1, wherein the outer frame and the stitching plate are both made of plastic.

* * * * *